US005922173A

United States Patent [19]

Neun et al.

[11] Patent Number: 5,922,173

[45] Date of Patent: Jul. 13, 1999

[54] PAPER FORMING ACTIVITY CONTROL WITH LIFTING VARIABLE INERTIAL STIMULATION BLADES WITH LIMITED-VENT INDENTED-SURFACES

[75] Inventors: John A Neun, Clifton Park; Jeffrey P. Bachand, Queensbury; Keith Carlton, Glens Falls; Daniel Grogan, Greenwich, all of N.Y.

[73] Assignee: Thermo Fibertek Inc., Waltham, Mass.

[21] Appl. No.: 08/837,755

[22] Filed: Apr. 22, 1997

[51] Int. Cl.[6] ..... D21F 1/54

[52] U.S. Cl. ..... 162/352; 162/351; 162/374

[58] Field of Search ..... 162/352, 354, 162/374, 364, 351

[56] References Cited

U.S. PATENT DOCUMENTS

| | | |
|---|---|---|
| 3,573,159 | 3/1971 | Sepall . |
| 3,595,747 | 7/1971 | Walser . |
| 3,598,694 | 8/1971 | Wiebe . |
| 3,738,911 | 6/1973 | Kienzl et al. . |
| 3,823,062 | 7/1974 | Ward et al. . |
| 3,870,597 | 3/1975 | Getman et al. . |
| 3,874,998 | 4/1975 | Johnson . |
| 3,922,190 | 11/1975 | Cowan . |
| 4,123,322 | 10/1978 | Hoult . |
| 4,315,799 | 2/1982 | Turek et al. . |
| 4,425,189 | 1/1984 | Mimura . |
| 4,459,176 | 7/1984 | Goodnow . |
| 4,544,449 | 10/1985 | Arav . |
| 4,687,549 | 8/1987 | Kallmes . |
| 4,789,433 | 12/1988 | Fuchs . |
| 4,838,996 | 6/1989 | Kallmes . |
| 4,909,906 | 3/1990 | Bartelmuse et al. . |
| 4,957,598 | 9/1990 | Corbellini . |
| 5,011,577 | 4/1991 | Hansen et al. . |
| 5,089,090 | 2/1992 | Hansen . |
| 5,116,477 | 5/1992 | Bubik et al. ..... 162/352 |
| 5,169,500 | 12/1992 | Mejdell . |
| 5,221,438 | 6/1993 | Takeuchi . |
| 5,242,547 | 9/1993 | Corbellini et al. . |
| 5,262,010 | 11/1993 | Bubik et al. . |
| 5,387,320 | 2/1995 | Jaakkda . |
| 5,389,207 | 2/1995 | Rodriguez et al. . |
| 5,393,382 | 2/1995 | Corbellini et al. . |
| 5,421,961 | 6/1995 | Miller . |
| 5,437,769 | 8/1995 | Bando et al. . |
| 5,486,270 | 1/1996 | Schiel . |
| 5,522,969 | 6/1996 | Corbellini et al. . |
| 5,562,807 | 10/1996 | Baluha . |

FOREIGN PATENT DOCUMENTS

| | | | |
|---|---|---|---|
| 87/06633 | 11/1987 | WIPO | 162/352 |

OTHER PUBLICATIONS

U.S. Patent Application SN 08/600,833 Filed: Feb. 12, 1996 For: Velocity Induced Drainage Method and Unit.

"Theory of Wing Sections, Including a Summary of Air Foil Data" by Ira H. Abbott and Albert E. Von Doenhoff.

"Incompressible Aerodynamics, An Account of the Theory and Observation of the Steady Flow of Incompressible Fluid Past Aerofoils, Wings and Other Bodies" edited by Bryan Thwaites.

*Primary Examiner*—Karen M. Hastings

*Attorney, Agent, or Firm*—Kane, Dalsimer, Sullivan, Kurucz, Levy, Eisele and Richard, LLP

[57] ABSTRACT

A papermaking apparatus such as a Fourdrinier table which includes a long blade and a trail blade. In the first aspect of the invention, the long blade includes an upper undulated surface with vents passing from the upper undulated surface to the lower surface of the long blade which is at substantially atmospheric pressure. In the second aspect of the invention, the trail blade includes an elevator-type device for adjusting the vertical position of the trail blade. The first and second aspects may be used independently or simultaneously.

15 Claims, 1 Drawing Sheet

PAPER FORMING ACTIVITY CONTROL WITH LIFTING VARIABLE INERTIAL STIMULATION BLADES WITH LIMITED-VENT INDENTED-SURFACES

BACKGROUND OF THE INVENTION

1. Field of the Invention

This invention relates to the induction of stock activity and the control of drainage in a Fourdrinier table, particularly by the use of lifting variable inertial stimulation blades which can further include limited-vent indented surfaces.

2. Description of the Prior Art

Stock activity in the early part of a Fourdrinier table is critical to the production of a good sheet of paper. Generally, stock activity can be defined as turbulence in the fiber-water slurry on the forming fabric. This turbulence takes place in all three dimensions. Activity plays a major part in developing good formation by impeding stratification of the sheet as it is formed, by breaking up fiber flocs, and by causing fiber orientation to be random. Typically, stock activity quality is inversely proportional to water removal from the sheet. That is, activity is typically enhanced if dewatering is retarded. As water is removed, activity becomes more difficult because the sheet becomes set, and because water, which is the primary media in which the activity takes place, becomes scarcer. Good paper machine operation is therefore a balance between activity and drainage.

There are a number of conventional methods to promote activity and drainage. A table roll causes a large positive pressure pulse to be applied to the sheet resulting from water under the forming fabric being forced into the incoming nip formed by the roll and forming fabric. This positive pulse has a positive effect on stock activity by causing flow perpendicular to the sheet surface. Similarly, on the exiting side of the roll, large negative pressures are generated, which greatly enhance drainage. Table rolls are generally limited to relatively slow machines because at high speeds, the positive and negative pulse amplitudes become excessively large. Foils are used to promote and control activity and drainage. A vacuum pulse is generated by the nip formed by the forming fabric and conventional foil as the fabric passes over the foil. Activity is generated by using a number of consecutively placed foils, encouraging a positively reinforced activity in the stock. Another type of foil, sometimes referred to as a "posi-blade", incorporates a positive incoming nip to generate a positive and negative pressure pulse. The amplitude of the pressure pulse is determined in a large part by the angle formed by the fabric and the incoming edge of the foil. This type of foil simulates a table roll, but with much lower amplitude positive and negative pressure pulses. The amplitudes are determined by the speed of the machine and the angles of the foils.

Often, Fourdrinier tables are mechanically shaken to promote stock activity, especially on slower, narrower machines. While the shaking might be a good way to enhance formation it is undesirable because it is difficult and expensive to control and maintain, and generally punishing on the equipment on and around the Fourdrinier Table. For paper making in general, most activity inducing systems have the negative feature of excessive drainage.

In patent application Ser. No. 08/600,833, entitled "Velocity Induced Drainage Method and Unit", filed on Feb. 12, 1996, U.S. Pat. No. 5,830,322, discloses an alternate way of creating activity and drainage. The apparatus disclosed therein, and illustrated herein as FIG. 1, decouples activity and drainage and therefore provides independent control and optimization of activity and drainage. The device typically uses a long blade with a controlled, at least partially non-flat or undulated, surface to induce initial activity in the sheet, and limits the flow downstream of the blade through placement of a trail blade to control drainage. Drainage is enhanced if the area between the long blade, the forming fabric and trail blade remains flooded and surface tension is maintained between the water above and below the fabric. However, the implementation of this device has revealed phenomena previously not fully appreciated. The first occurs in the "counterflow zone" over the long blade, particularly at the undulated portion, where the incompressible fluid is pumped through the forming fabric. This was expected. However, the second activity is much more vigorous and had not been fully appreciated. As the forming fabric spans the relatively long distance between the lead edge of the long blade and the trail blade, it deflects downwardly because of the forces acting on it. These forces are gravitational and also result from the vacuum induction as the fabric travels along the long blade. The latter predominates by far. The wire takes on the shape of a skewed catenary as the forces are asymmetrical along the wire between the support points. If the long blade is high enough or the fabric deflection is severe enough, the wire will contact the long blade and the catenary shape will be further distorted. The activity is induced when the fabric reaches the trail blade. The fabric path must make a rapid transition from the deflected state to the horizontal state very quickly at the leading edge of the trail blade because of the high tensions acting on the fabric path. The fabric path therefore changes sharply as the fabric travels around the sharp leading edge of the trail blade. Inertial forces prevent the fluid slurry of the paper sheet from following the fabric, and inertial activity is induced as the sheet lifts vertically.

Submerged drainage in a Fourdrinier fabric is disclosed by U.S. Pat. No. 5,522,969 to Corbellini et al. entitled "Submerged Drainage Method for Forming and Dewatering a Web on a Fourdrinier Fabric" and U.S. Pat. No. 5,242,547 to Corbellini et al. entitled "Submerged Drainage System for Forming and Dewatering a Web on a Fourdrinier Fabric". Positional control of elements in papermaking apparatus is disclosed in U.S. Pat. No. 5,486,270 to Schiel entitled "Angularly Adjustable Drainage Foil for Paper Machines"; U.S. Pat. No. 5,421,961 to Miller entitled "Forming Board Position Control System"; U.S. Pat. No. 5,262,010 to Bubik et al. entitled "Dewatering Device with Adjustable Force Elements for the Web-Forming Section of a Papermaking Machine"; and U.S. Pat. No. 5,221,438 to Takeuchi et al. entitled "Supporting Device for Dewatering Elements".

U.S. Pat. No. 3,595,747 to Walser entitled "Suction Box Covers with Rows of Drainage Openings for Uniform Dewatering" and U.S. Pat. No. 5,562,807 to Baluha entitled "Cross Direction Fiber Movement and Dewatering Device".

OBJECTS AND SUMMARY OF THE INVENTION

It is therefore an object of this invention to provide controlled stock activity in the papermaking process, particularly in a Fourdrinier table.

It is therefore a further object of this invention to provide controlled drainage in the papermaking process, particularly in a Fourdrinier table.

It is therefore a still further object of this invention to provide controlled stock activity decoupled from controlled drainage in the papermaking process, particularly in a Fourdrinier table.

It is therefore a still further object of this invention to reduce the amount of fluid which is pumped through the forming fabric as the fluid passes over the undulated portion of a long blade in the papermaking process, particularly in a Fourdrinier table.

It is therefore a final object of this invention to control the sharpness of the path change as the fabric passes over the trail blade in the papermaking process, particularly in a Fourdrinier table.

A first aspect of this invention provides downwardly sloped atmospheric vents extending from the undulated portions of the long blade of the Fourdrinier table. This venting of the counterflow zone to atmosphere equalizes the pressure above and below the fabric and therefore controls the downward force on the fabric thereby controlling deflection with respect to the trail blade, controlling inertial activity and eliminates the vacuum or deflection of the fabric over the counterflow zone. Only gravitation force deflects the fabric, and it has been demonstrated that gravitational deflection is negligible except for very long spans. Furthermore, if the venting is limited or throttled, then deflection can be controlled in an analog manner and activity can be "tuned" for optimum sheet formation. The control of the venting can be uniform or non-uniform across the surface of the long blade for cross-machine profile control or variable drainage in the machine direction. The surface of the long blade can be indented locally or in the cross-machine direction to provide for the vents.

A second aspect of the invention uses an elevator-type configuration to raise or lower the trail blade. This controls stock activity by controlling the sharpness of the path change as the forming fabric travels over the trail blade thereby controlling the inertial activity. When a trail blade is elevated the angle formed by the oncoming fabric and the trail blade surface is maximized. This maximizes the rapid directional change of the fabric and therefore maximizes the inertial activity. Conversely, when the trail blade is lowered, the angle is minimized, and the inertial activity is decreased or eliminated. If the tail of the long lead blade is high enough such that the fabric lands on it as the trail blade is lowered the effect is enhanced.

Additionally, in the second aspect of the invention, successive blades can be cascaded so that the trail blade of the first pair becomes the lead blade of the second pair, etc. As elevations of successive blades are changed, the activity generated over the entire apparatus is affected. Activity can therefore be finely tuned to desired levels. As the path of the fabric determines the effectiveness of the device, it can be used with any length blade, and can be used in conjunction with other control devices, such as the vented blades of the first aspect of this invention.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
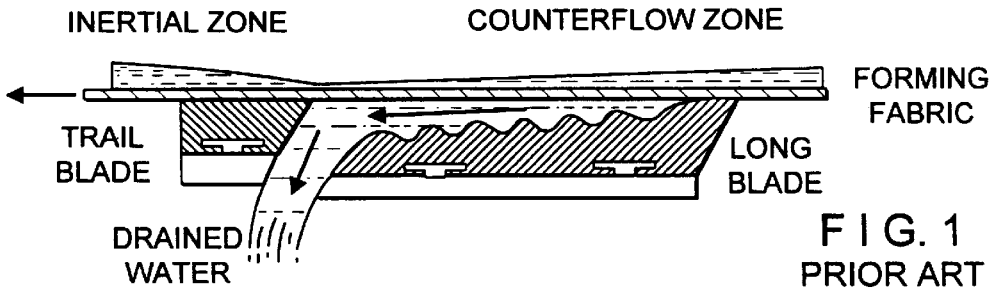
FIG. 1 PRIOR ART
FIG. 1 is a cross-sectional view of a prior art blade arrangement.
Figure 2:
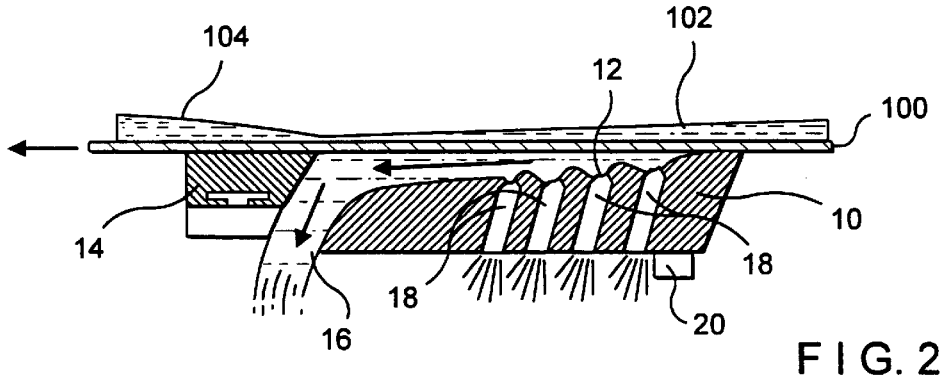
FIG. 2 is a cross-sectional view of the vents of a first aspect of the present invention.

Referring now to the drawings in detail wherein like numerals indicate like elements throughout the several views, one sees that FIG. 2 is a cross-sectional view of a first aspect of the invention. The long blade 10 has undulations 12 which generally decline in the machine direction. The forming fabric 100 traverses a path immediately above and supported by the long blade 10 and then immediately above and supported by trail blade 14. A counterflow zone 102 is formed above long blade 10 and an inertial zone 104 is formed above trail blade 14. Water is both above and below forming fabric 100 and is drained through the passageway 16 immediately between long blade 10 and trail blade 14. In the area of the undulations 12 of long blade 10, generally downwardly extending vents 18 are formed. Vents 18 allow liquid flow therethrough and equalize the pressure between the counterflow zone 102 and atmosphere. This venting of the counterflow zone 102 to atmosphere equalizes the pressure above and below the forming fabric 100 and therefore controls the downward force on the forming fabric 100 thereby controlling deflection with respect to the trail blade 14, controlling inertial activity and eliminating the vacuum or deflection of the fabric over the counterflow zone 102. Only gravitation force deflects the fabric, and it has been demonstrated that gravitational deflection is negligible except for very long spans. Furthermore, if the venting is limited or throttled, such as is illustrated by valve or throttle 20, then deflection can be controlled in an analog manner and activity can be "tuned" for optimum sheet formation. The control of the venting can be uniform or non-uniform across the surface of the long blade 10 for cross-machine profile control or variable drainage in the machine direction. The vents 18 can be throttled independently or in gangs of any combination. The surface of the long blade can be indented locally or across the cross-machine direction to provide for the vents 18.

Alternatively, the vents 18 can be connected to a cavity in which the vacuum level is controlled. Thus the pressure level between the wire and blade can be independently controlled.

Figure 3:
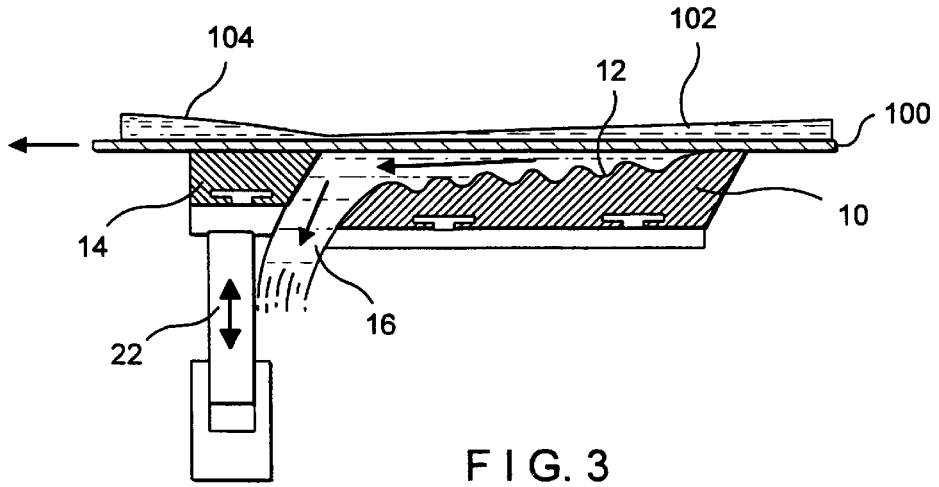
FIG. 3 is a cross-sectional view of the elevator-type configuration of a second aspect of the present invention.
Figure 4A:
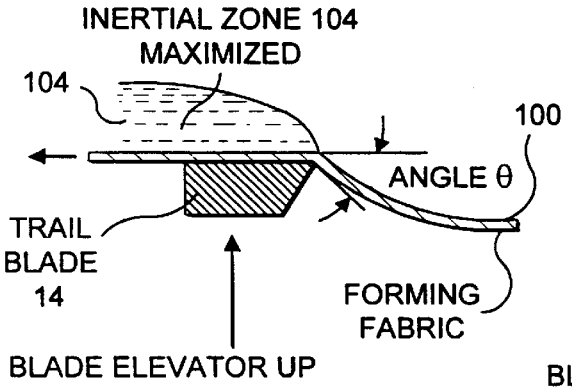
FIG. 4A is a cross-sectional view of the effect on the inertial zone by raising the trail blade in the second aspect of the invention.
Figure 4B:
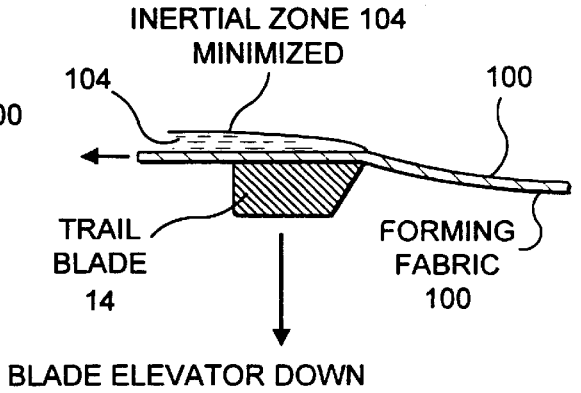
FIG. 4B is a cross-sectional view of the effect on the inertial zone by lowering the trail blade in the second aspect of the invention.

Referring now to FIG. 3, one sees a cross-sectional view of a second aspect of the invention. As in FIG. 2, the long blade 10 has undulations 12 which generally decline in the machine direction. The forming fabric 100 traverses a path immediately above and supported by the long blade 10 and then immediately above and supported by trail blade 14. A counterflow zone 102 is formed above long blade 10 and an inertial zone 104 is formed above trail blade 14. Water is both above and below forming fabric 100 and is drained through the passageway 16 immediately between long blade 10 and trail blade 14. The trail blade 14 further includes blade elevator 22 which raises and lowers trail blade 14. The vertical raising and lowering of trail blade 14 varies the angle Θ (see FIG. 4A). That is, lowering trail blade 14 by way of blade elevator 22 reduces Θ as shown in FIG. 4B while raising trail blade 14 by way of blade elevator increases Θ as shown in FIG. 4A. This controls stock activity by controlling the sharpness of the path change as the forming fabric 100 travels over the trail blade 14 thereby controlling the inertial activity. When a trail blade 14 is elevated the angle Θ formed by the oncoming fabric and the trail blade surface is maximized. This maximizes the rapid directional change of the forming fabric 100 and therefore maximizes the inertial activity. Conversely, when the trail blade 14 is lowered by blade elevator 22, the angle Θ is minimized, and the inertial activity is decreased or eliminated. If the tail of the long lead blade is high enough such that the forming fabric 100 lands on it as the trail blade 14 is lowered the effect is enhanced.

Additionally, in the second aspect of the invention, successive blades can be cascaded so that the trail blade of the first pair becomes the lead blade of the second pair, etc. As elevations of successive blades are changed, the activity generated over the entire apparatus is affected. Activity can therefore be finely tuned to desired levels. As the path of the fabric determines the effectiveness of the device, it can be used with any length blade, and can be used in conjunction with other control devices, such as the vented blades of the first aspect of this invention.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. In a fourdrinier portion of papermaking apparatus comprising:

a non-planar lead blade for generating activity in stock forming a sheet on a forming fabric, said blade having a non-planar upper surface and a lower surface, said lead blade being mounted in a fixed position;

a rearwardly spaced trail blade with a gap formed between the lead blade and trail blade for drainage;

a single layer path for forming fabric which extends over said lead blade and said trail blade; and means for adjusting the vertical height of the trail blade with respect to the lead blade to change the hydro dynamics of the fluid passing thereover so as to control activity in the fluid and the drainage that occurs in the gap between the lead blade and the trailing blade.

2. The invention in accordance with claim 1 including at least one vent aperture extending from said upper surface to said lower surface for drainage of liquid therethrough wherein said at least one vent aperture is vented to substantially atmospheric pressure at said lower surface of said long blade.

3. The invention in accordance with claim 2 wherein said upper surface of said lead blade includes undulations.

4. The invention in accordance with claim 3 wherein said at least one vent aperture includes means for throttling drainage of liquid therethrough.

5. The invention in accordance with claim 4 wherein said at least one vent aperture includes a plurality of vent apertures.

6. The invention in accordance with claim 5 wherein said plurality of vent apertures includes at least two groups of vent apertures, each of said groups including independent means for throttling drainage of liquid therethrough.

7. The invention in accordance with claim 1 wherein said lead blade includes at least one vent aperture extending from said upper surface to said lower surface for drainage of liquid therethrough.

8. The invention in accordance with claim 3 which includes a plurality of lead blades and respective trail blades.

9. The invention in accordance with claim 2 wherein said at least one vent aperture is vented to vacuum at said lower surface of said long blade.

10. The invention in accordance with claim 9 wherein said upper surface of said lead blade includes undulations.

11. The invention in accordance with claim 10 wherein said at least one vent aperture includes means for throttling drainage of liquid therethrough.

12. The invention in accordance with claim 11 wherein said at least one vent aperture includes a plurality of vent apertures.

13. The invention in accordance with claim 12 wherein said plurality of vent apertures includes at least two groups of vent apertures, each of said groups including independent means for throttling drainage of liquid therethrough.

14. The invention in accordance with claim 10 which includes a plurality of lead blades and respective trail blades.

15. In a papermaking apparatus comprising:

a long blade mounted in a fixed position with an upper surface and a lower surface, said upper surface including undulations;

a trail blade spaced from said long blade thereby defining a gap through which water drains;

a forming fabric path which extends over said long blade and said trail blade;

means for adjusting a vertical height of said trail blade;

said long blade being longer than said trail blade in a machine direction; and said long blade including at least two groups of vent apertures extending from said upper surface to said lower surface for drainage of liquid therethrough, each of said at least two groups of vent apertures further including independent means for throttling drainage of liquid therethrough.

* * * * *